United States Patent [19]

Lazareck

[11] 4,117,985

[45] Oct. 3, 1978

[54] SHREDDER HAMMER WITH REPLACEABLE TIP

[76] Inventor: Jack A. Lazareck, Box 26, Group 509, R.R. 5, Winnipeg, Manitoba, Canada, R2C 2Z2

[21] Appl. No.: 807,221

[22] Filed: Jun. 16, 1977

[30] Foreign Application Priority Data

May 12, 1977 [CA] Canada ..... 278244

[51] Int. Cl.[2] ..... B02C 13/28

[52] U.S. Cl. ..... 241/197

[58] Field of Search ..... 241/189 R, 191, 194, 241/197

[56] References Cited

U.S. PATENT DOCUMENTS

| | | | |
|---|---|---|---|
| 2,534,302 | 12/1950 | Sennholtz | 241/197 |
| 2,994,486 | 4/1961 | Trudeau | 241/197 |
| 3,367,585 | 2/1968 | Ratkowski | 241/197 |
| 3,510,076 | 5/1970 | Perdue | 241/197 |
| 3,838,826 | 10/1974 | Wallace | 241/197 |
| 3,979,078 | 9/1976 | Boddeker | 241/191 |

*Primary Examiner*—Howard N. Goldberg
*Attorney, Agent, or Firm*—Lerner, David, Littenberg & Samuel

[57] ABSTRACT

A hammer is provided which is useful in solid waste, e.g. metal, shredding operations. The hammer includes a shank member adapted to be connected to a supporting shaft, and a replaceable tip member which is subject to wear substantially along its leading and lower portions. The shank end and the tip are slidably interconnected along a common face, e.g., by a tongue and groove interrelationship. Cooperating keyway pocket and hooked key interconnecting means are provided on the shank and on the tip, with a significant portion of the keyway pocket/hooked key interengagement being in the shank. A slot passes through the shank and the tip adjacent the trailing edge thereof. A wedge is inserted into the slot. Finally, means are provided for retaining the wedge in the slot. In this way a tip member is provided which is very easily replaced when worn.

10 Claims, 10 Drawing Figures

SHREDDER HAMMER WITH REPLACEABLE TIP

BACKGROUND OF THE INVENTION (i) Field of the Invention

This invention relates to a hammer for solid waste shredding, and in particular to a two-piece hammer including a replaceable wear tip removably mounted on the lower end of the hammer shank for shredding of solid waste, e.g. metal.

(ii) Description of the Prior Art

Hammers with replaceable tips are well known, and various types are used for pulverizing or crushing materials. Shredding hammers are used in the scrap industry, and in particular in the scrap automobile industry. It is advantageous to use shredding techniques rather than compacting methods to dispose of scrapped metal objects, for example automobiles, since shredding permits the eventual separation and retrieval of the various materials in the automobile.

As a result of the particular structure of automobiles, it is desired to employ a shredding hammer which provides a large contact area on impact. However, this contact area is subject to extreme wear. The greater the contact area, the more effective is the operation of the hammer, with respect both to the shredding operation and to the expected life of the hammer.

During the operation of a conventional auto shredder, the hammers act as wearing parts coming in contact with the infeed material. The hammers are held onto a spinning rotor by shafts, of which there may be four or more, dependent on the design of the shredder. In conventional practice, once worn out, the hammers are removed by pulling the shafts out of the hammer holes. The old hammer is then thrown away.

(iii) List of Prior Art Patents

Among the prior art patents disclosing hammers having a shank with a replaceable wear tip are the following Canadian patents:

No. 261,065 issued May 25, 1926 to G. P. Lucas;
No. 417,341 issued Dec. 28, 1943 to The American Brake Shoe and Foundry Company;
No. 417,342 issued Dec. 28, 1943 to The American Brake Shoe and Foundry Company;
No. 450,604 issued Aug. 17, 1948 to Nordberg Manufacturing Company;
No. 517,579 issued Oct. 18, 1955 to The Galigher Company;
No. 526,473 issued June 19, 1956 to Bath Iron Works Corporation;
No. 585,573 issued Oct. 20, 1959 to American Brake Shoe Company;
No. 651,407 issued Oct. 30, 1962 to Poor & Company;
No. 735,419 issued May 31, 1966 to L. E. Toews;
No. 803,998 issued Jan. 14, 1969 to Abex Corporation;
No. 803,999 issued Jan. 14, 1969 to Abex Corporation;
No. 889,292 issued Dec. 28, 1971 to Abex Corporation; and
No. 897,139 issued Apr. 4, 1972 to Abex Corporation;

and the following United States patents:

Nos. 3,455,040; 3,457,998; 3,685,178; 3,812,608; 2,904,907; 2,904,908;
Nos. 2,951,300; 2,993,656; 3,107,455; 3,197,894; 3,129,899; 3,196,956;
Nos. 3,254,726; 3,278,126; 3,236,463; 3,268,012; 3,459,998; 3,367,585;

Nos. 3,410,010; 2,962,233; 2,994,486; 3,453,755; 3,834,764; 3,844,619;
Nos. 3,904,247; 3,850,359; 3,410,010; 3,704,753; 3,097,259; 3,371,476;
Nos. 3,371,436; 3,006,089; 3,774,324; 3,545,691; 3,503,562; and 3,738,586.

However, none of these patents disclose hammers having easily replaceable tips in which the tip is securely held in place. Moreover, present auto shredders do not use replaceable tip hammers extensively since the requirements of an easily replaceable tip having a large body contact area exposed to wear have not been met by any of the abovementioned known types of replaceable tip hammers.

SUMMARY OF THE INVENTION (i) Aims of the Invention

Accordingly, it is an object of the present invention to provide a hammer for use in an auto shredding or like operation, such hammer having a replaceable wear tip which is easily attached to and removed from the hammer shank and is locked in place and whereby a substantial portion of the replaceable tip is exposed to wear.

It is another object of the present invention to provide a hammer with a replaceable tip which may be replaced without dismantling the shank from the supporting shafts.

It is yet another object of the present invention to provide a hammer with a replaceable tip whereby the securement means between the replaceable tip and the supporting shank are positively enforced as a result of the operation of the hammer.

It is a further object of the present invention to provide a hammer with a replaceable tip in which the tip will remain securely in place and may be easily replaced when the tip is worn out with the use of basic tools readily available on the job site, and with a minimum of skill.

It is a still further object of the present invention to provide a hammer wherein the securement means between the replaceable tip and the shank are not exposed to wear during the shredding operation.

(ii) Statement of Invention

By this invention, a hammer of the type used in shredding operations is provided comprising: a shank member adapted to be secured on a supporting shaft; a replaceable tip member which is subject to wear substantially along the leading and lower portions thereof, the shank and the tip being slidably interconnected along a common face by a tongue and groove interrelationship and including a cooperating keyway pocket and hooked key on the shank and the tip, a significant interengaging portion of such keyway pocket/hooked key being within the shank; a slot passing through the shank and the tip adjacent the trailing edge thereof; a wedge inserted into the slot; and means for retaining the wedge in the slot.

(iii) Other Features of the Invention

In one further feature of the invention, the shank is provided with a central depending tongue and a rearwardly directed keyway pocket, and the tip is provided with a central groove and a cooperating rearwardly directed hooked key.

In another further feature of the invention, the keyway pocket and the hooked key are disposed approximately centrally along the common faces of the shank and the tip.

In still another further feature of the invention, the wedge retaining means comprises a socket head bolt whose tip engages the wedge.

In another further feature of the invention, the tip is provided with a wear indicating means thereon, e.g. an aperture therethrough.

In another further feature of the invention, the hammer includes a tip handling hook on the tip, and shank handling hole therethrough the shank.

BRIEF DESCRIPTION OF THE DRAWINGS

In the accompanying drawings.

Figure 1:
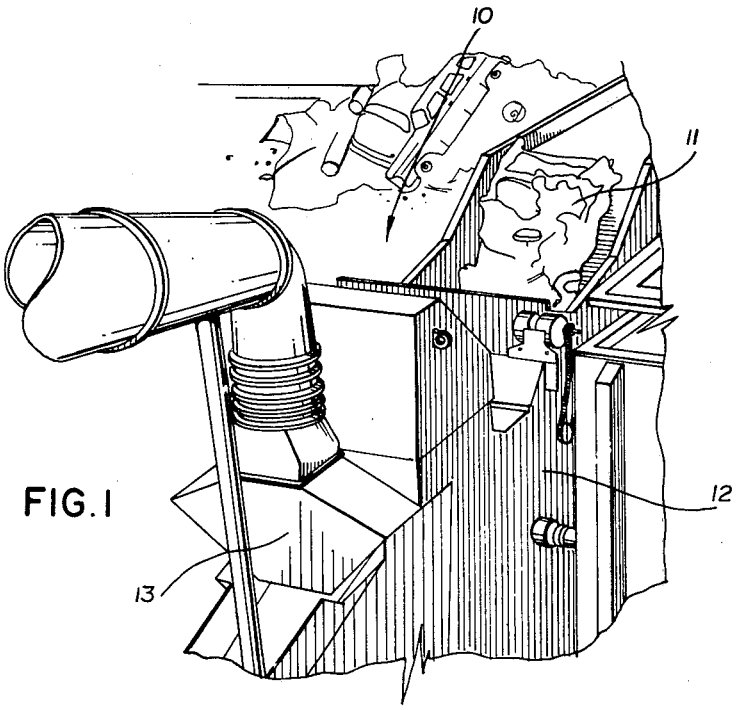
FIG. 1 is a perspective view of an auto shredder with which the hammer of this invention may be used.

DESCRIPTION OF PREFERRED EMBODIMENTS (i) Description of FIG. 1

As seen in FIG. 1, the auto shredder 10 includes an inlet 11 for the introduction of the scrap metal to an internal chamber 12 within which are, for example, four shafts on each of which are mounted the hammer of an embodiment of this invention, the shafts being secured to a spinning rotor. The shredded metal is discharged through outlet 13.

Figure 2:
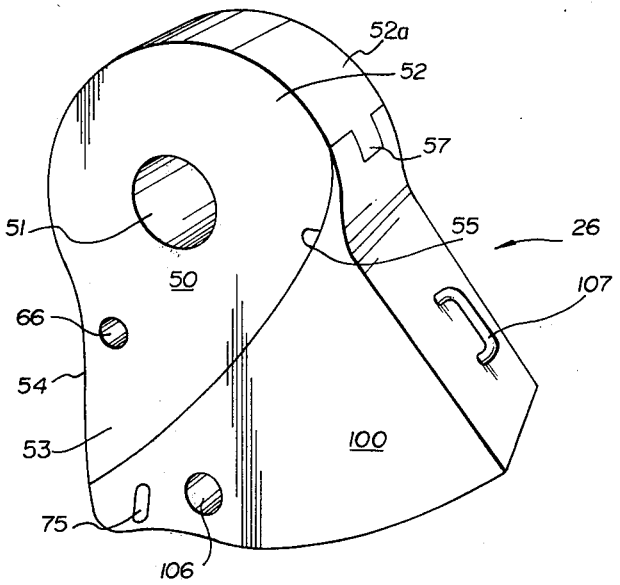
FIG. 2 is a perspective view of the hammer of one embodiment of the present invention.

(ii) Description of FIG. 2

As seen in FIG. 2, the hammer 26 includes a shank member 50 and an associated replaceable tip 100. Also seen is a common wedge 75. The hammer shank 50 is, in one embodiment of this invention, of the type secured to a shaft for rotation in an automobile shredding mill. The shank is adapted to be secured to the shafts by means of large cylindrical opening 51.

Figure 3:
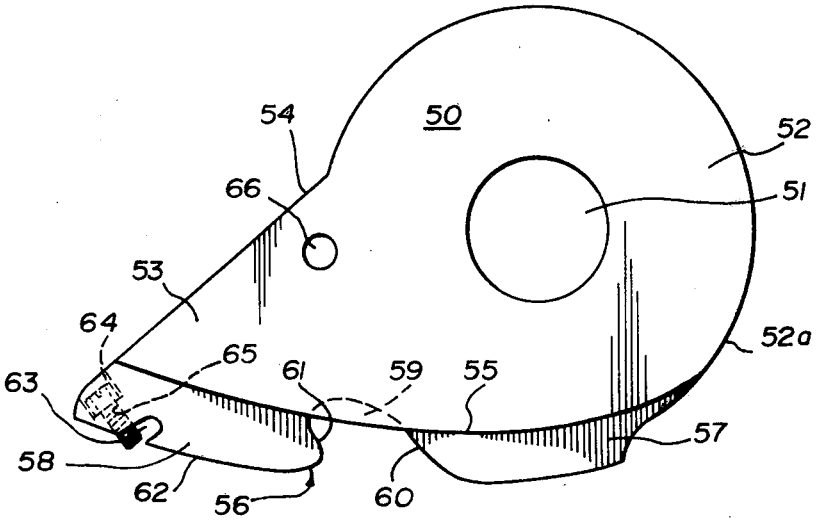
FIG. 3 is a side view of the shank of the hammer of one embodiment of the present invention.

(iii) Description of FIG. 3

As seen more clearly in FIG. 3, the hammer shank 50 includes a generally cylindrical head 52 and a trailing tail portion 53 providing a leading circumferential wall 52*a* and a flat trailing wall 54. Walls 52*a* and 54 are joined to provide a bottom edge 55. Depending from bottom edge 55 is a central tongue 56 including a forward flange 57, a rear flange 58 and a central keyway pocket portion 59. Pocket 59 is rearwardly skewed and includes a leading engaging face 60 and a trailing restraining face 61. Disposed near the rear wall 54 of rear flange 58 and extending upwardly from edge 62 is a forwardly slanting slot 63. Bored into the rear wall 54 in rear flange 58 is a countersunk hole 64 which leads, via tapped hole 65 to slot 63. The shank 50 may be made, for example, of a high tensile strength, low carbon steel, or manganese or abrasion-resistant high carbon steel.

Figure 4:
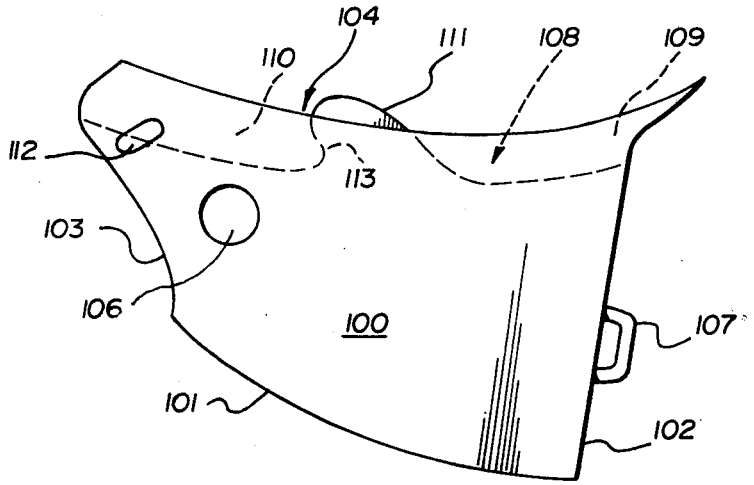
FIG. 4 is a side view of the replaceable tip of the hammer of one embodiment of the present invention.
Figure 5:
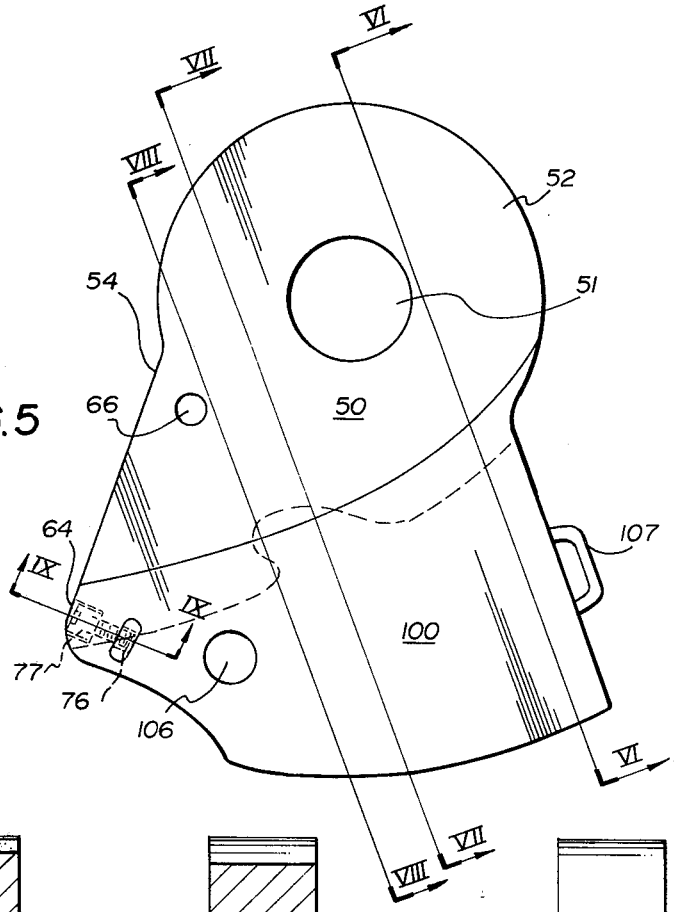
FIG. 5 is a side view of the combined shank/replaceable tip in the hammer of one embodiment of the present invention.

(iv) Description of FIG. 4

The replaceable tip 100 of the hammer as shown in particular in FIG. 4 is the element that is subject to wear, in a manner to be described hereafter. Since the replaceable tip 100 is the part which is subject to wear, it is made of a material selected to resist wear. Examples include manganese, steel, or high carbon alloys or an abrasion-resistant high carbon steel.

The top edge 104 of the tip 100 is provided with a central groove 108 which permits mating with the tongue 56 of shank 50. Specifically, a leading channel 109 of central groove 108 is adapted to mate with forward flange 57, and a trailing channel 110 of central groove 108 is adapted to mate with trailing flange 58. Disposed between leading channel 109 and trailing channel 110 and coextensive therewith is rearwardly leaning hooked key 111 which is adapted to mate with keyway pocket 59 of shank 50.

Disposed near the end of rear wall 103 and passing through the body of the tip 100 as well as through the trailing channel 110 is a transverse forwardly slanted slot 112, which is of the same width as, and is adapted to mate with, slot 63, and is approximately twice as long.

(v) Description of FIGS. 5, 6, 7, 8 and 9

Figure 6:
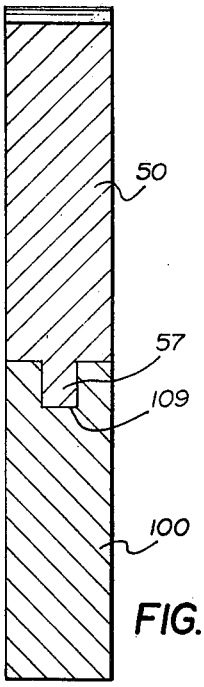
FIG. 6 is a view through the line VI—VI of FIG. 5.
Figure 7:
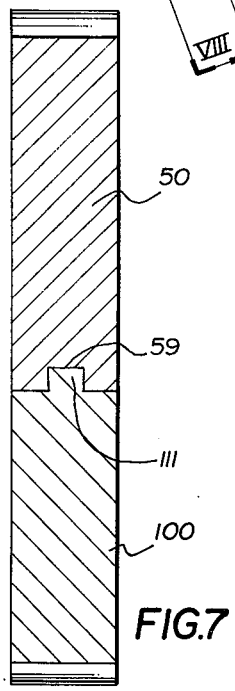
FIG. 7 is a view through the line VII—VII of FIG. 5.
Figure 8:
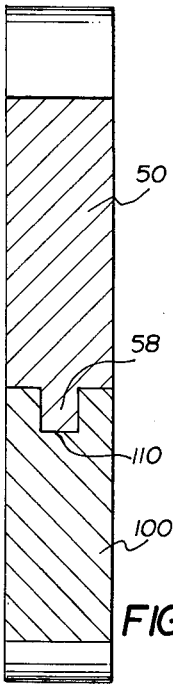
FIG. 8 is a view along the line VIII—VIII of FIG. 5.
Figure 9:
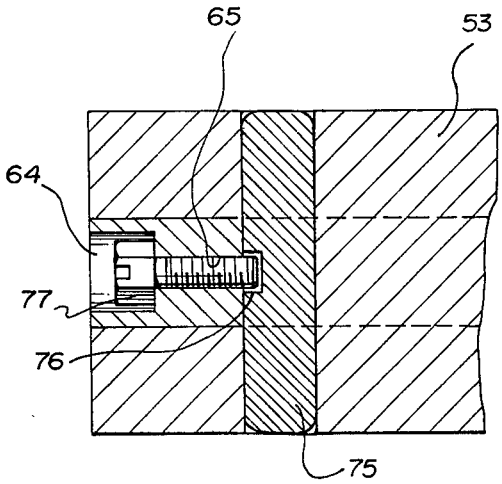
FIG. 9 is a view along the line IX—IX of FIG. 5.

The construction and interrelationship between tongue 56 and central groove 108 is more clearly shown in FIGS. 6, 7 and 8. Thus tongue 57 engages and is embraced by groove 109 while tongue 58 engages and is embraced by groove 110. However, hooked key 111 projects upwardly into keyway pocket 59. Thus the main engagement between the shank and the tip occurs within the shank, and not, as in previous arrangements, solely within the tip.

Thus when the hammer tip 100 is secured to the shank 50, the tongue 56 of shank 50 is slid into central groove 108 such that the trailing edge 113 of hooked key 111 abuts restraining face 61 of keyway pocket 59. When the tip 100 and the shank 50 are so mated, slot 112 and slot 63 are lined up. Then a wedge 75 is inserted therein. Wedge 75 is, in a preferred embodiment, rectangular in cross section and is provided with a threaded hole 76 to accept a socket head bolt 77 (see FIG. 9). Socket head bolt 77 is threaded through hole 65 and is directed into hole 76 in wedge 75 through countersunk hole 64 by threading through tapped hole 65. In this manner, the tip 100 is secured to the shank 50 by the retaining wedge 75 which is, in turn, retained by socket head bolt 77. Removal of socket head bolt 77 frees wedge 75 and the removal of wedge 75 permits tip 100 to be slid forward from shank 50, and thereby to be separated for replacement.

Figure 10:
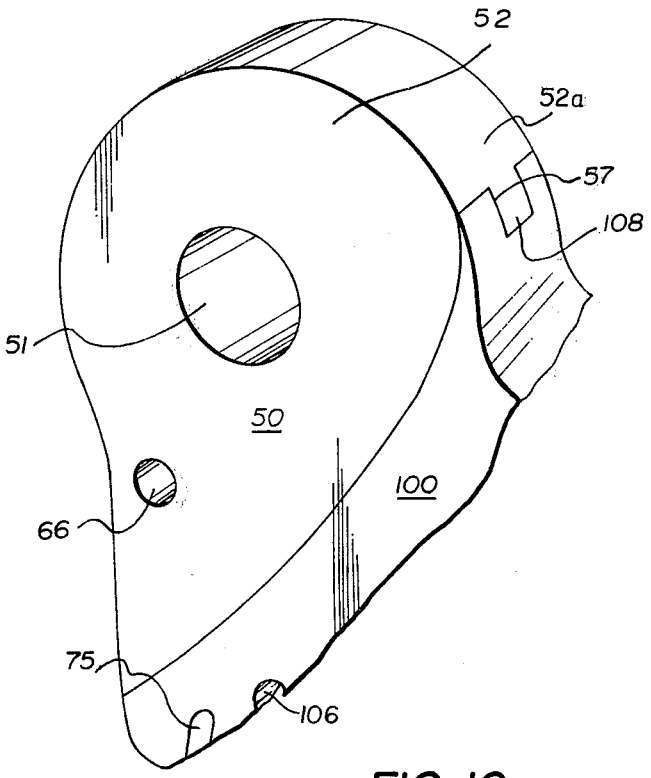
FIG. 10 is a perspective of the hammer of one embodiment of the present invention, showing a worn out tip.

(vi) Description of FIG. 10

The tip 100 is subject to considerable wear along its leading and lower portions, i.e., along edge 102 and base 101. FIG. 10 shows a tip 100 that has been subject to wear and is ready for replacement by a new tip. In view of the pattern of wear of the tip 100, the hammer of this invention provides an easily replaceable tip which provides long life by providing a secure mating between the tip 100 and the shank 50 by providing a significant portion of such mating within the shank. In particular the surface contact between the depending tongues 57, 58 and the recesses 109, 110 is complemented by the interaction between hooked key 111 and the keyway pocket 59. During the operation of the hammer 26, the impact forces are absorbed by the contact of trailing edge 113 against restraining face 61. This distributes the impact shock throughout the entire hammer 26. Since the keyway pocket 59 and hooked key are sloped rearwardly, the impact shock serves to reinforce the union between the tip 100 and the shank 50.

Operation of the Invention

Wedge 75 is not subject to impact shock and thus does not accept impact forces for the reasons outlined above. Its principal function is to retain the tip 100 onto the shank 50. When the tip 100 has been worn down, as indicated by the disappearance of the wear hole and wear indicator 106, it is replaced by a new tip 100 in the following manner: socket head bolt 77 is removed from the rear of the hammer 26 and wedge 75, thereby freeing wedge 75, which is then free to slide out of slot 112. With wedge 75 removed, the worn tip 100 is taken out by being slid forward in order to allow hooked key 111 to be extracted out of keyway pocket 59. The new tip 100 is then inserted in the hammer 26 by following the same steps in reverse, namely: sliding the tongue 56 in the groove 108 until the hooked key 111 engages the keyway, inserting the retaining wedge 75 into the slot 112 and securing the wedge 75 with the socket head bolt 77. To assist in the handling of the tip 100 and shank 50 during the changeover from an old tip to a new tip, the tip 100 is provided with lift hook 107 which is used to support the tip. The shank is provided with hole 66 which accepts a rod which is used to rotate the shank on its shaft to place it in a position which easily accepts the tip.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A hammer of the type used in shredding operations comprising: a shank member adapted to be secured on a supporting shaft; and a replaceable tip member which is subject to wear substantially along the leading and lower portions thereof; means for interconnecting said shank and said tip, said interconnecting means comprising a tongue and groove interrelationship for slidably interconnecting said shank and said tip along a common face, and a cooperating keyway pocket and hooked key on said shank and said tip, with a significant operative interengaging portion of such keyway pocket/hooked key being within said shank and being so interrelated as to tend to retain said tip on said shank during use; and locking means, separate and distinct from said interconnecting means, for locking said tip to said shank, said locking means comprising a slot passing through said shank and said tip adjacent the trailing edge thereof, said slot being disposed through a side of said tip which is perpendicular to said leading portion of said tip a wedge inserted into said slot; and means for retaining said wedge in said slot.

2. The hammer of claim 1 wherein said shank is provided with a central depending tongue and a rearwardly directed keyway pocket, and wherein said tip is provided with a central groove and a cooperating rearwardly directed hooked key.

3. The hammer of claim 2 wherein said keyway pocket and said hooked key are disposed approximately centrally along the common faces of the shank and the tip.

4. The hammer of claim 1 wherein said wedge retaining means comprises a socket head bolt whose tip engages the wedge.

5. The hammer of claim 1 wherein the tip is provided with a wear indicating means thereon.

6. The hammer of claim 5 wherein the wear indicating means comprises an aperture therethrough.

7. The hammer of claim 1 including a lift hook on the tip.

8. The hammer of claim 1 including a shank handling hole therethrough.

9. The hammer of claim 1 wherein said keyway pocket is disposed within said tongue, and wherein said hooked key projects outwardly away from said groove.

10. The hammer of claim 1 wherein said keyway pocket is disposed within said shank and wherein said hooked key is integral with said tip.

* * * * *